US007887331B1

(12) United States Patent
Lin

(10) Patent No.: US 7,887,331 B1
(45) Date of Patent: Feb. 15, 2011

(54) LIGHT BULB SOCKET ADAPTER

(76) Inventor: Ming-Ing Lin, 4F., No. 50 3, Sanmin Rd., Luzhou City, Taipei Hsien (TW)

( * ) Notice: Subject to any disclaimer, the term of this patent is extended or adjusted under 35 U.S.C. 154(b) by 0 days.

(21) Appl. No.: 12/508,776

(22) Filed: Jul. 24, 2009

(51) Int. Cl.
*H01R 39/00* (2006.01)

(52) U.S. Cl. ..... 439/8

(58) Field of Classification Search ..... 439/8, 439/9, 640, 643, 644
See application file for complete search history.

(56) References Cited

U.S. PATENT DOCUMENTS 2,231,565 A * 2/1941 De Reamer et al. ..... 439/8
7,104,828 B1 * 9/2006 Lin ..... 439/337

* cited by examiner

*Primary Examiner*—Phuong K Dinh
(74) *Attorney, Agent, or Firm*—patenttm.us

(57) ABSTRACT

A light bulb socket adapter includes an adapter base and at least one lamp holder. The adapter base includes a base having a ring contact and a tip contact. The at least one lamp holder is oscillatingly mounted to the adapter base through an oscillating connection assembly. The oscillating connection assembly has a ball-holding mechanism mounted on an end opposite to the base of the adapter base, and at least one ball fixedly connected with the respective lamp holder and oscillatingly engaged with the ball-holding mechanism. The present invention allows the light bulb mounted thereon to irradiate in a desired direction and a bayonet-type bulb to be mounted in a conventional screw-type socket without requiring an additional socket adapter.

6 Claims, 6 Drawing Sheets

LIGHT BULB SOCKET ADAPTER

BACKGROUND OF THE INVENTION

1. Field of the Invention

The present invention relates to a light bulb socket, and more particularly to a light bulb socket adapter adjusting the lighting direction of a light bulb mounted thereon.

2. Description of Related Art

To keep abreast with the constant pursuit of higher living standard and everchanging sense of style, lighting plays an indispensable role in daily life of people. Because of its critical effect dominating interior decorating and gigantic market demand behind that, countless lighting products and accessories emphasizing practical or aestheic consideration are ceaselessly introduced to meet customer's demand in the extremely competitive market.

Due to the energy-saving advantage, LED light bulb and energy-saving bulb have been widely accepted by customers nowadays. LED light bulb has few pins to be inserted in the corresponding LED bulb socket, a bayonet-type socket. Such bayonet-type socket differs from the conventional bulb sockets normally mounted at home and other premises and dedicated for screw-type light bulb only. An alternative for using LED light bulb and energy-saving bulb in these occasions is to provide an additional socket adapter capable of converting the screw-type socket into the bayonet-type socket. Such socket adapter has a bayonet socket and a screw-in portion to be inserted in a screw-type socket. Although such socket adapter addresses a solution to alternatively replace a regular screw-type socket, it brings up another issue that some energy-saving light bulbs and LED light bulbs mounted to the socket adapter have a narrow lighting range because of their nature being a pointing light source instead of being a radiating light source, e.g. an incandescent bulb. The light bulbs of conventional lighting products are mounted fixedly and are prone to a blind zone. Certain track lighting sets may open another door to add the angle adjustment feature to the conventional light bulb. However, such structures usually don't take the function of socket adapter into account.

SUMMARY OF THE INVENTION

The main objective of the present invention is to provide a light bulb socket adapter, which enables to orient at least one light bulb mounted thereon to irradiate in a desired direction respectively and provide the adaptability to mount a bayonet-type bulb to a conventional screw-type bulb socket without requiring an additional adapter.

To achieve the foregoing objective, the aforementioned light bulb socket adapter has an adapter base, an oscillating connection assembly and at least one lamp holder.

The adapter base has a large end, a small end, an open chamber and a base. The open chamber is formed at the large end. The base is formed at the small end and has a ring contact and a tip contact. The oscillating connection assembly is formed on the adapter base. The at least one lamp holders is oscillatingly mounted to the adapter base through the oscillating connection assembly.

The oscillating connection assembly has a ball-holding mechanism mounted on an end opposite to the screw thread portion of the adapter base, the adapter base further has multiple positioning pins mounted inside the open chamber, and at least one ball is fixedly connected with the respective lamp holder and oscillatingly engaged with the ball-holding mechanism.

The ball-holding mechanism has a first cover, a second cover and multiple adjustment springs.

The first cover and the second cover are mounted to cover the open chamber and have at least one first opening and at least one second opening corresponding to the at least one ball and each having a diameter smaller than a respective diameter of the at least one ball. The multiple adjustment springs are mounted to surround the multiple positioning pins so as to urge against the second cover and a bottom portion of the adapter base. Therefore, the at least one ball is retained and oscillated within the at least one first opening and the at least one second opening respectively. The lamp holder oscillates in a range of −50 degrees to 50 degrees.

Each of the lamp holder has a top, a bottom, an inner chamber, two pin slots defining through the top, and a screwing hole defining through the bottom to communicate with the inner chamber.

Each of the at least one ball has a body, a stud and wire track. The body is extended from outside the body to screw into the screwing hole of the bottom of the lamp holder. The wire track defines through the stud and the body to communicate with the inner chamber of the lamp holder and the open chamber of the adapter base. The ball is screwed in the respective lamp holder with the stud and has a wire track therein communicating with the respective lamp holder and the adapter base. Two slots are symmetrically formed beside the wire track.

Two tabs are symmetrically mounted to a circumference of the second opening with respect to a center thereof. An annular flange is mounted to a circumference of the first opening and tapers upwardly so as to hold the ball within the first cover and the second cover.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
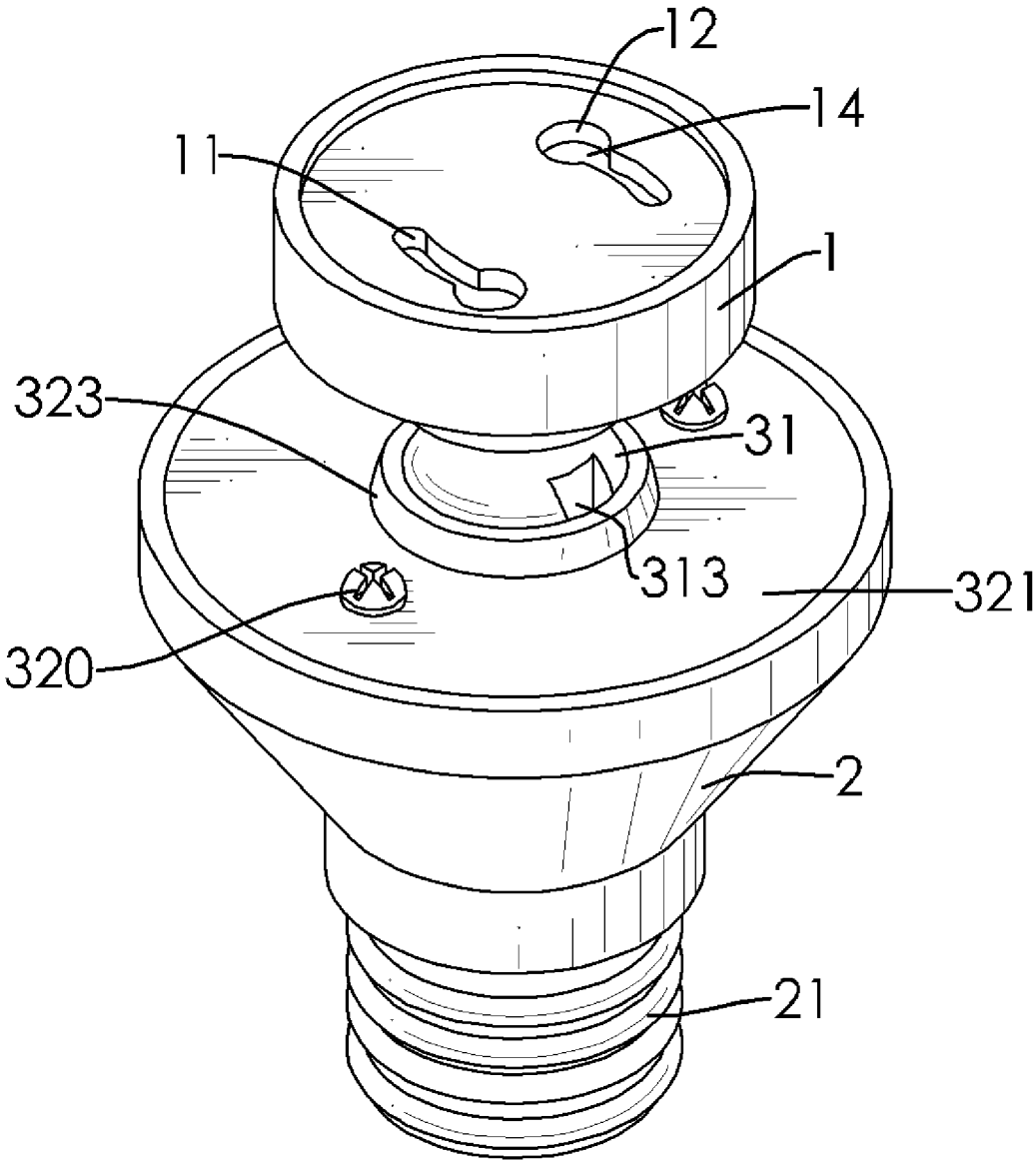
FIG. 1 is a perspective view of a light bulb socket adapter in accordance with a first preferred embodiment of the present invention.
Figure 2:
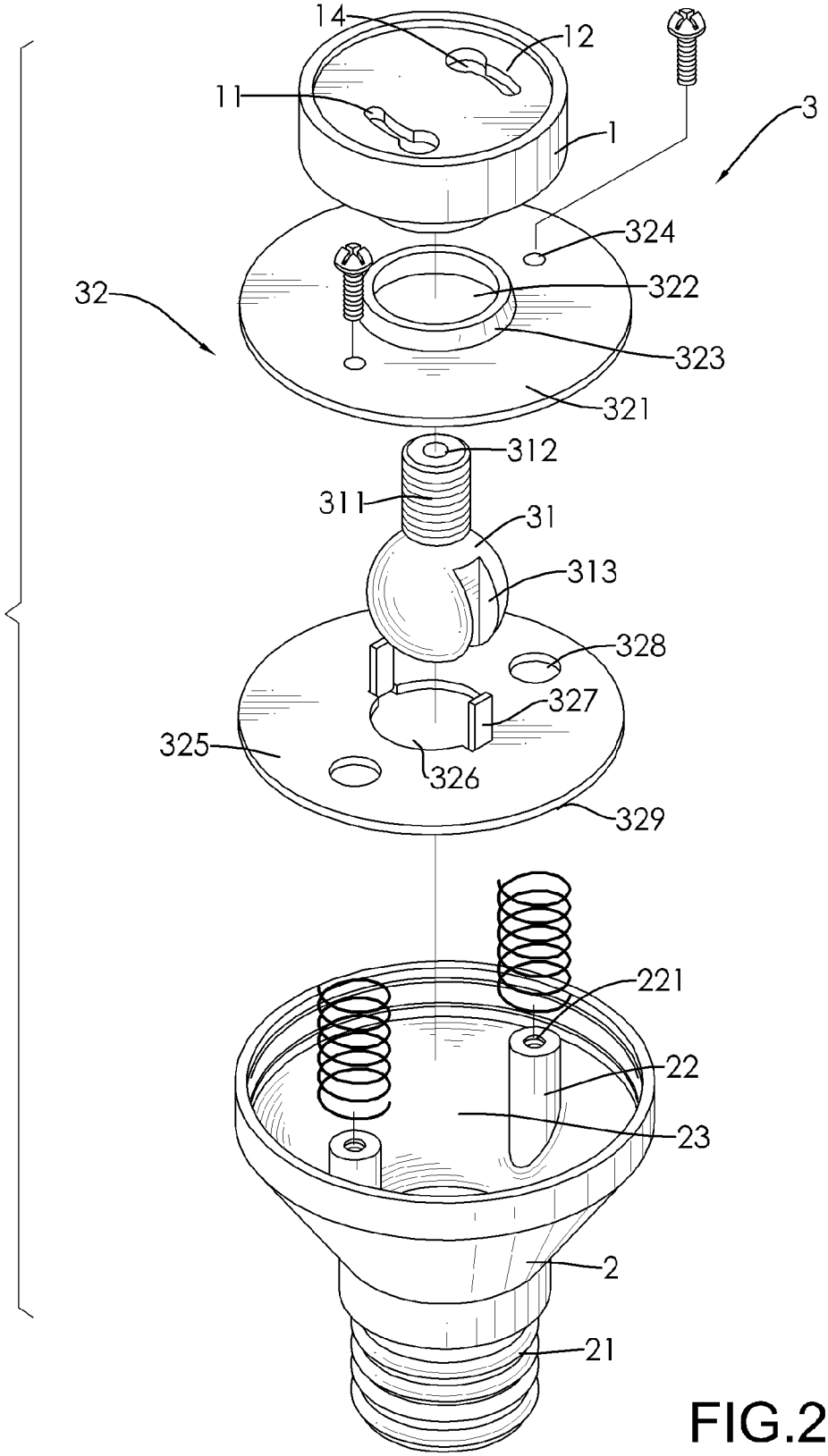
FIG. 2 is an exploded view of the light bulb socket adapter in accordance with the first preferred embodiment of the present invention.
Figure 3:
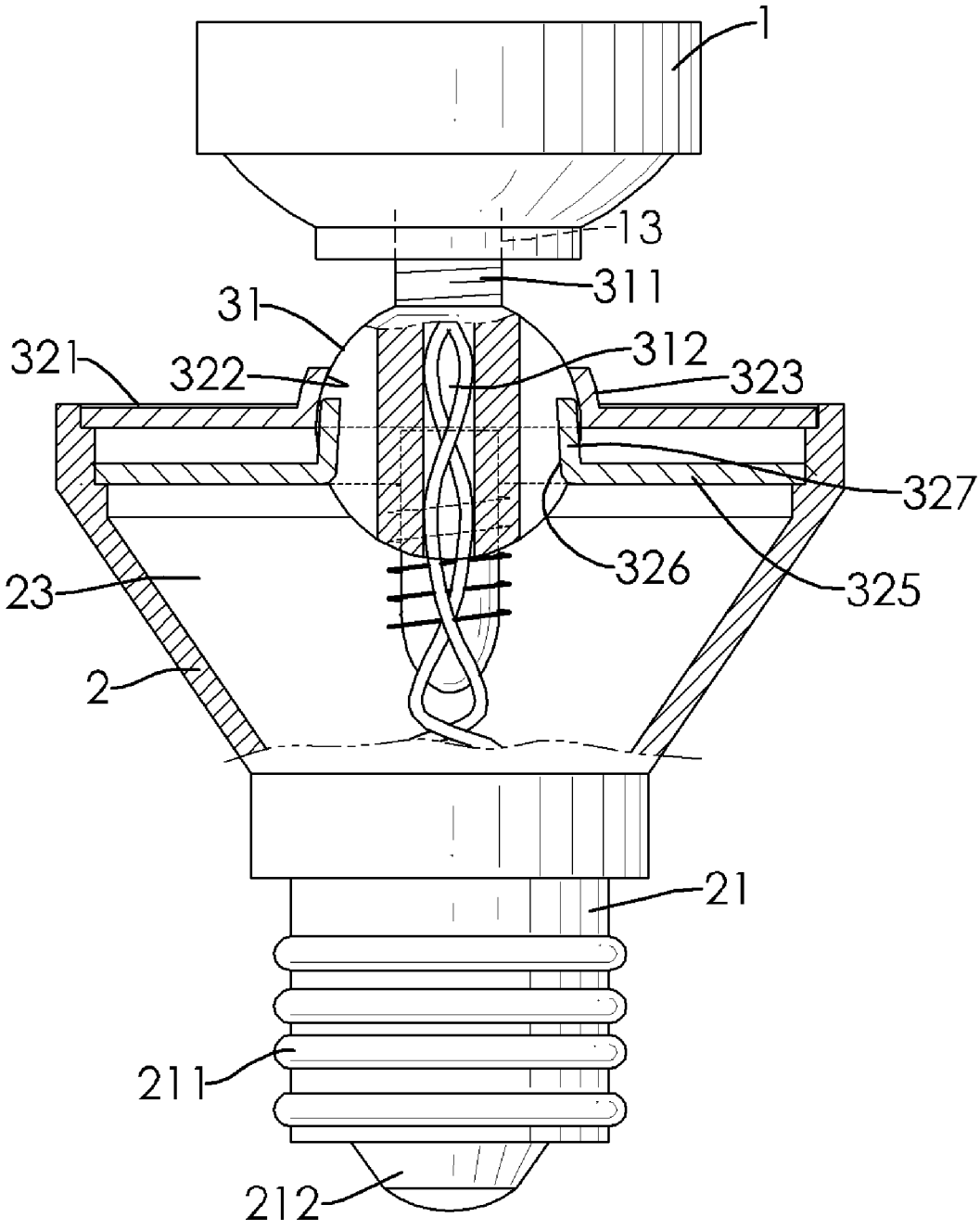
FIG. 3 is a partial cross-sectional view of the light bulb device in accordance with the first preferred embodiment of the present invention while a lamp holder is erected.

With reference to FIGS. 1, 2 and 3, a light bulb socket adapter in accordance with a first embodiment of the present invention includes a lamp holder (1), an adapter base (2) and an oscillating connection assembly (3).

The lamp holder (1) has a bayonet-type socket to be inserted by an LED bulb or a bayonet-type energy-saving bulb. The adapter base (2) has a large end, a small end and two positioning pins (22). The small end has a base (21) of a screw-type bulb having a ring contact (211) and a tip contact (212) is fitted in a screw-type socket, and an open chamber (23) is formed at the large end. The two positioning pins (22) are mounted inside the chamber of the adapter base. Each of the positioning pin (22) has a positioning hole (221), which is a sunken hole therein.

With reference to FIG. 1, FIG. 2 and FIG. 3, the lamp holder (1) is oscillatingly mounted to the adapter base (2) through an oscillating connection assembly (3). The lamp holder (1) has a top, a bottom, an inner chamber, two pin slots (11, 12) defining through the top, and a screwing hole (13) defining through the bottom to communicate with the inner chamber. The oscillating connection assembly (3) has a ball-holding mechanism (32) and a ball (31). The ball (31) has a body (314) and a stud (311) and a wire track (312) defining through the stud (311) and the body. The stud (311) is extended from outside the body (314) to screw into the screwing hole (13) of the bottom of the lamp holder (1). Therefore, the wire track (312) is communicated with the inner chamber (14) of the lamp holder (1) and the open chamber (23) of the adapter base (2). Two slots (313) are symmetrically formed outside of the body and beside the wire track (312). Wires are received in the wire track (312), the open chamber (23) and the inner chamber of the lamp holder (1) to electrically connect the lamp holder (1) and the ring contact (211) and the tip contact (212) of the base (21) of the adapter base (2).

Figure 4:
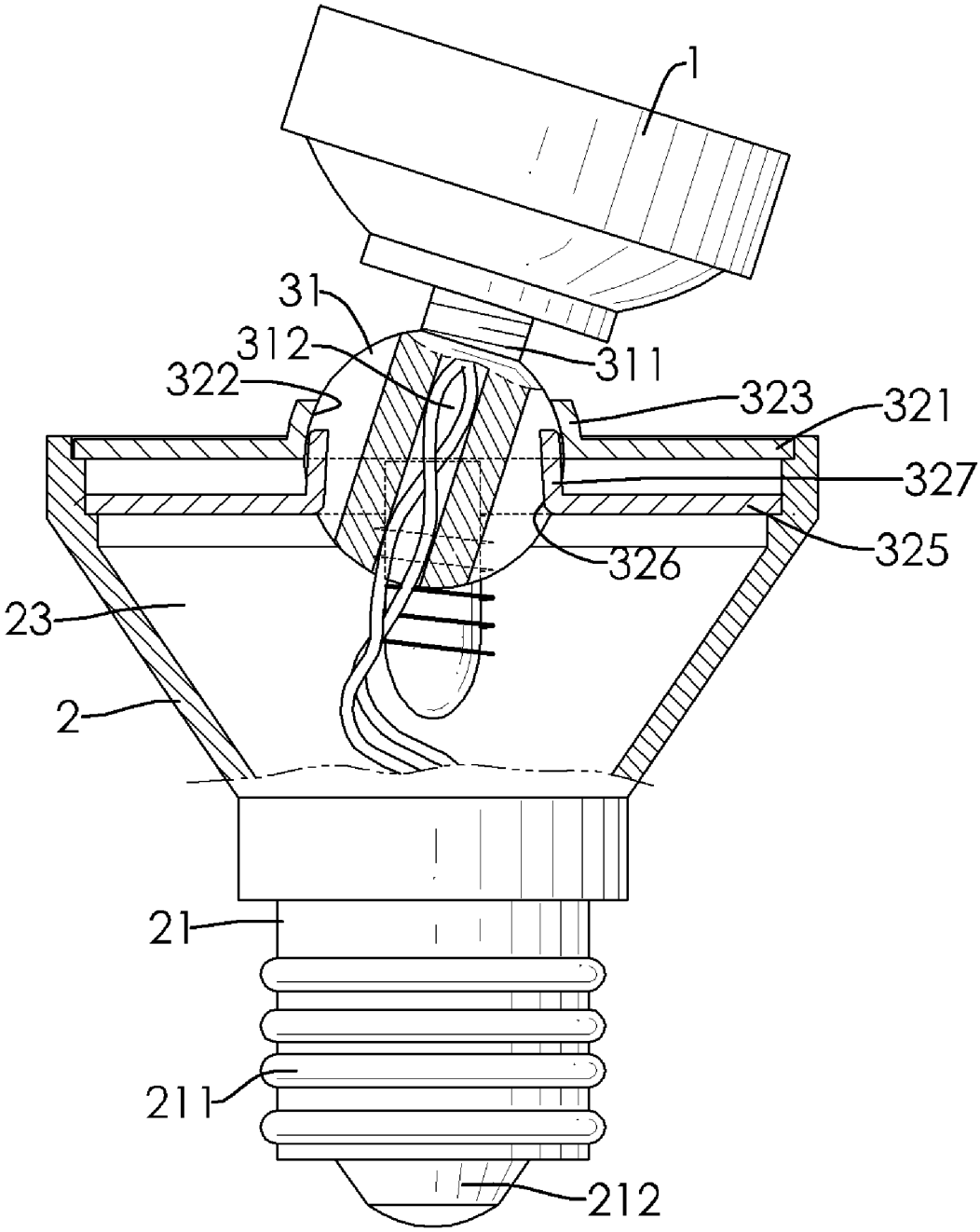
FIG. 4 is a partial cross-sectional view of the light bulb device in accordance with the first preferred embodiment of the present invention while the lamp holder is oriented to the right.
Figure 5:
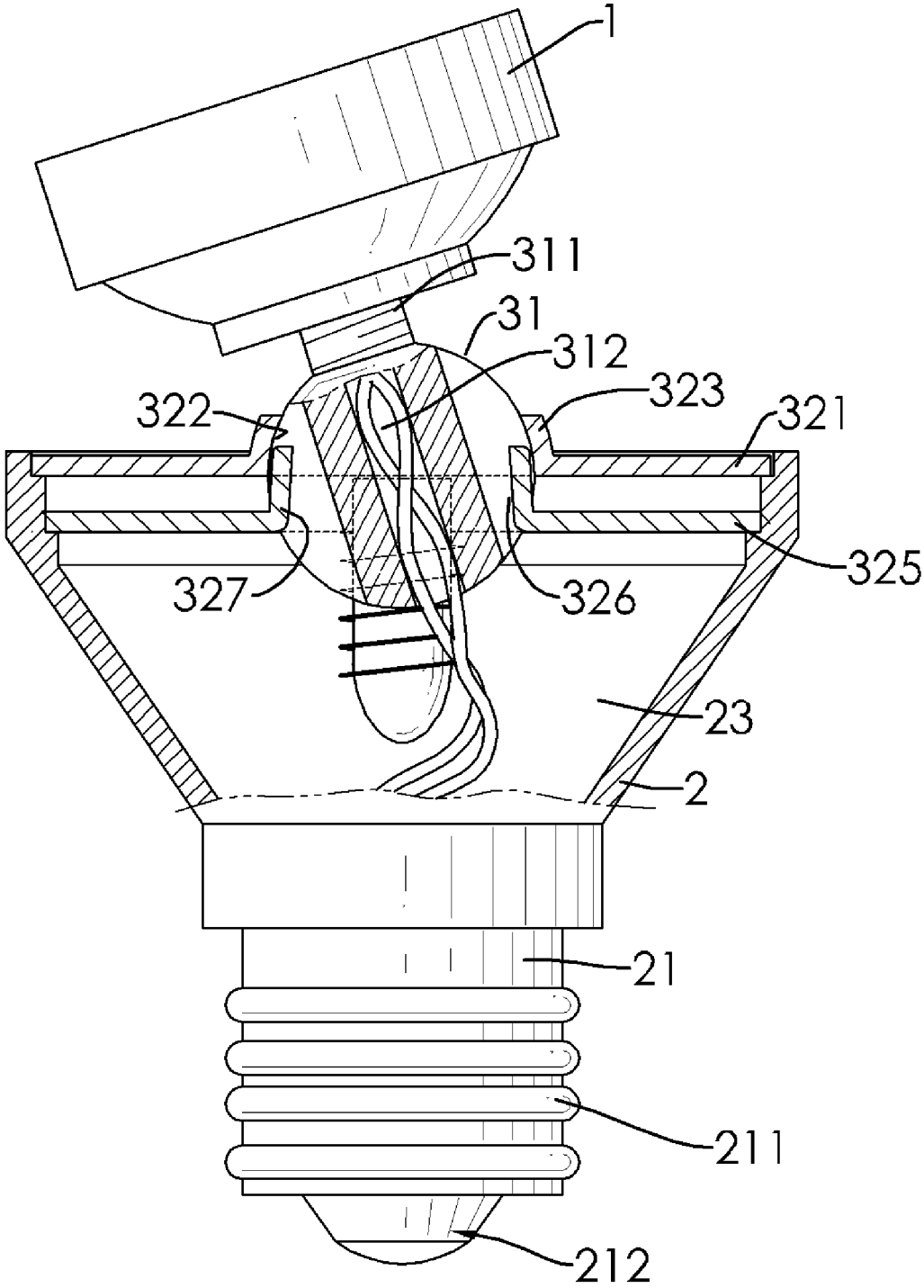
FIG. 5 is a partial cross-sectional view of the light bulb device in accordance with the first preferred embodiment of the present invention while the lamp holder is oriented to the right.

The ball-holding mechanism (32) has a first cover (321), a second cover (325) and two adjustment springs (329). The first cover (321) has a first opening (322). The second cover (325) has a second opening (326). The first cover (321) and the second cover (325) are mounted to cover the open chamber (23). Both diameters of the first opening (322) and the second opening (326) are smaller than a diameter of the ball (31). An annular flange (323) is mounted to a circumference of the first opening (322) and tapers upwardly. Two tabs (327) are symmetrically mounted to a circumference of the second opening (326) with respect to a center thereof and received in the two slots (313) of the ball (31) respectively. With reference to FIG. 4 and FIG. 5, as the width of the slot (313) is formed to be slighter larger than that of the tab (327), the movement the ball (31) along the circumferential direction of the first opening (322) is limited and minor Given the annular flange (323), the tabs (327) and the slots (313), the ball (31) is retained in the first cover (321) and the second cover (325), and major movement of the ball is along the slots (313) and minor movement is along the circumferential direction of the first opening (322). With further reference to FIG. 2, two adjustment springs (329) are respectively sleeved around the two positioning pins (22) so as to urge against the bottom of the adapter base (2) and the bottom of the second cover (325). The compression force of the adjustment spring (329) passes to the ball (31) through the second cover (325) to adequately hold the second cover (325) so as to facilitate freely oscillating the ball (31). Therefore, when the lamp holder (1) or the ball (31) oscillates, the two tabs (327) guide the ball (31) to move within the respective slot (313) and to the extreme positions without twisting the wire received in the wire track (312) and the open chamber (23), thereby reducing the risk of rupturing the wire.

Each of two screws (320) is inserted into and engaged with the positioning holes (221) through a first hole (324) on the first cover (321) and a second hole (328) on the second cover (325). Therefore, the first cover (321) is firmly fastened on the adapter base (2). The quantity of the screw (320) corresponds to that of the first hole (322), the second hole (328), the positioning hole (221) and the adjustment spring (329).

An assembling procedure of the first embodiment of the light bulb socket adapter is further introduced as follows.

The adjustment springs (329) are sleeved around the positioning pins (22) respectively in the open chamber (23). The second cover (325) is placed on the adjustment springs (329) with the two tabs (327) facing upwards so that the adjustment springs (329) urge against the bottom of the adapter base (2) and the bottom of the second cover (325). The ball (31) is placed to correspond to the second opening (326) of the second cover (325). The tabs (327) are inserted into the two slots (313) of the ball (31). The first cover (321) is placed on the second cover (325) keeping the ball (31) partially exposed through the first opening (322) of the first cover (321). The first cover (321) is fixedly fastened with the positioning pins (22) through the screws (320) so that the second cover (325) is driven by the adjustment springs (329) to approach to the first cover (22) and hold the ball (31) between the first cover (22) and the second cover (23). The combination of the tabs (327) and the slots (313) guides the ball (31) to oscillate in a range of −50 degrees to 50 degrees. At last, the ball (31) is screwed in the lamp holder (1) to complete the assembly of the light bulb socket adapter.

Figure 6:
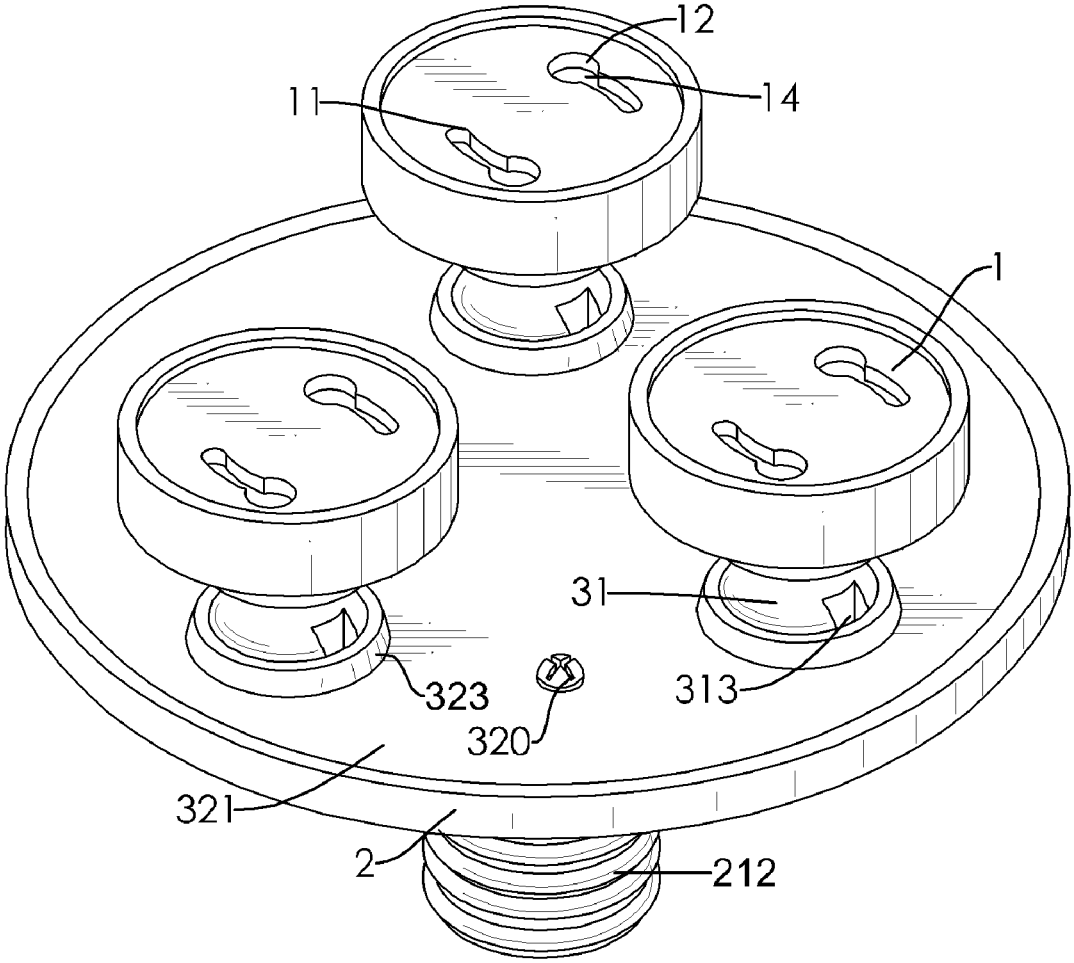
FIG. 6 is a perspective view of a light bulb socket adapter in accordance with a second preferred embodiment of the present invention.

Differing from the light bulb socket adapter as shown in FIG. 1, with reference to FIG. 6, a light bulb socket adapter in accordance with a second embodiment of the present invention has three lamp holders (1) mounted on a base adapter (2). In the present embodiment, to correspond to the three lamp holders (1), three first openings (322) and three annular flanges (323) are formed on the first cover (321), three second openings (326) are formed on the second cover and two tabs are mounted to a circumference of each of the second openings, and two slots (313) are formed on each of the balls (31). The lamp holders (1) are so located that any lamp holder (1) having a bulb thereon doesn't conflict with other lamp holder (1) having a bulb thereon while the lamp holder (1) are oscillated. Such design satisfies the requirement of brighter luminance and various lighting directions of bulbs.

In contrast to prior art, the present invention enables a bayonet-type bulb to be applied to a screw-type socket without requiring an additional socket adapter or replacing the screw-type socket at all. Besides, the present invention allows to orient a light bulb mounted thereon to a desired direction and provide more than one lamp holder at the same time, thereby making the socket adapter more versatile.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A light bulb socket adapter, comprising:

an adapter base having a large end, a small end, an open chamber formed at the large end, multiple positioning pins mounted inside the open chamber and a base formed at the small end and having a ring contact and a tip contact;

an oscillating connection assembly formed on the adapter base and comprising:

a ball-holding mechanism mounted on an end opposite to the base of the adapter base; and multiple ball oscillatingly engaged with the ball-holding mechanism; and multiple lamp holders, each of the lamp holders fixedly connected with one of the balls and oscillatingly mounted to the adapter base through the oscillating connection assembly.

2. The light bulb socket adapter as claimed in claim 1, wherein the adapter base has an open chamber therein; and the ball-holding mechanism comprises:

a first cover mounted to cover the open chamber and having multiple first openings corresponding to the multiple balls, wherein each of the multiple first openings has a first diameter which is smaller than a diameter of the corresponding ball;

a second cover mounted to cover the open chamber, located under the first cover, and having multiple second openings aligned to the corresponding first openings of the first cover, wherein each of the multiple second openings has a second diameter which is smaller than a diameter of the corresponding ball; and multiple adjustment springs mounted to surround the multiple positioning pins so as to urge against the second cover and a bottom portion of the adapter base;

whereby the multiple balls are retained and oscillated within the corresponding first and second openings.

3. The light bulb socket adapter as claimed in claim 1, wherein each of the lamp holders has a top, a bottom, an inner chamber, two pin slots defining through the top, and a screwing hole defining through the bottom to communicate with the inner chamber;

each of the multiple balls has:

a body;

a stud extended from outside the body to screw into the screwing hole of the bottom of the lamp holder; and a wire track defining through the stud and the body to communicate with the inner chamber of the lamp holder and the open chamber of the adapter base.

4. The light bulb socket adapter as claimed in claim 2, wherein each of the lamp holders has a top, a bottom, an inner chamber, two pin slots defining through the top, and a screwing hole defining through the bottom to communicate with the inner chamber;

each of the multiple balls has:

a body;

a stud extended from outside the body to screw into the screwing hole of the bottom of the lamp holder; and a wire track defining through the stud and the body to communicate with the inner chamber of the lamp holder and the open chamber of the adapter base.

5. The light bulb socket adapter as claimed in claim 1, wherein each of the lamp holders has a bayonet-type socket for an LED bulb or an energy-saving bulb.

6. The light bulb socket adapter as claimed in claim 1, wherein each of the lamp holders oscillates in a range of −50 degrees to 50 degrees.

* * * * *